US008393350B2

(12) United States Patent
Chiriac et al.

(10) Patent No.: US 8,393,350 B2
(45) Date of Patent: Mar. 12, 2013

(54) METHODS AND APPARATUS FOR INTRODUCING ADDITIVES INTO A FLUID FLOW

(75) Inventors: Victor A. Chiriac, Phoenix, AZ (US); David E. Bien, Glendale, AZ (US)

(73) Assignee: Vidacco International, LLC, Glendale, AZ (US)

( * ) Notice: Subject to any disclaimer, the term of this patent is extended or adjusted under 35 U.S.C. 154(b) by 1032 days.

(21) Appl. No.: 11/595,376

(22) Filed: Nov. 9, 2006

(65) Prior Publication Data

US 2007/0113892 A1 May 24, 2007

Related U.S. Application Data

(60) Provisional application No. 60/736,627, filed on Nov. 15, 2005.

(51) Int. Cl.
*E03D 9/02* (2006.01)

(52) U.S. Cl. ..... 137/268; 137/270; 137/599.12; 137/599.15; 222/360; 239/310

(58) Field of Classification Search ..... 137/205.5, 137/268, 564, 614.02, 614.055, 614.05, 270, 137/599.12, 599.15; 239/302, 310; 222/630
See application file for complete search history.

(56) References Cited

U.S. PATENT DOCUMENTS

| | | | | | |
|---|---|---|---|---|---|
| 620,321 | A * | 2/1899 | Dehn | 104/72 |
| 2,602,699 | A * | 7/1952 | Otto et al. | 422/119 |
| 2,711,928 | A * | 6/1955 | Randa | 137/599.14 |
| 2,989,979 | A * | 6/1961 | Karlson | 137/268 |
| 3,220,656 | A * | 11/1965 | Birdsong | 239/315 |
| 3,399,776 | A * | 9/1968 | Knuth | 210/234 |
| 3,476,137 | A * | 11/1969 | Eisendrath | 137/268 |
| 3,759,284 | A * | 9/1973 | Crowley et al. | 137/268 |
| 5,201,339 | A * | 4/1993 | Buchan et al. | 137/268 |
| 5,335,690 | A * | 8/1994 | Worth | 137/268 |
| 5,753,111 | A * | 5/1998 | Patton et al. | 210/167.01 |
| 6,588,929 | B1 * | 7/2003 | Dornbush | 366/160.2 |
| 7,399,346 | B2 * | 7/2008 | van der Maas | 96/117.5 |
| 2005/0145720 | A1 * | 7/2005 | Palmer | 239/310 |

* cited by examiner

*Primary Examiner* — Craig Schneider
(74) *Attorney, Agent, or Firm* — Hartman Titus PLC; Joseph W Mott

(57) ABSTRACT

Disclosed are an apparatus and methods for introducing additives into a fluid flow. An additive vessel, with chambers for one or more additives, is attached to a primary flow fixture in a configuration that permits a diversion of part of the primary flow through the additive vessel then back to the outlet of the primary flow fixture. When the apparatus is engaged, a part of the primary flow is diverted to the additive vessel, combines with the additive, and then is re-introduced to the fluid stream, exiting the primary flow fixture.

14 Claims, 3 Drawing Sheets

METHODS AND APPARATUS FOR INTRODUCING ADDITIVES INTO A FLUID FLOW

CLAIM TO DOMESTIC PRIORITY

This application claims the benefit of priority of U.S. Provisional Patent Application Ser. No. 60/736,627, filed Nov. 15, 2005.

TECHNICAL FIELD

The inventive subject matter described herein relates generally to introducing additives into a fluid flow, and particularly a method and apparatus for introducing additives into a flow of water.

BACKGROUND

In some situations, it may be desirable selectively to introduce one or more additives into a fluid flow. Various devices for introducing one or more additives into a fluid flow have been developed, in the past. However, some previously-developed devices do not enable a person easily to change the additive that is being introduced. Further, some devices may not be capable of providing a consistent additive introduction rate for different fluid flow rates.

DESCRIPTION OF THE EMBODIMENTS

Embodiments of the inventive subject matter include methods and apparatus for selectively introducing one or more additives into a fluid flow. Additives having fluid, granular, semi-solid, and/or solid forms may be introduced using various embodiments. Further, embodiments may be employed in a number of different applications, including but not limited to introducing one or more additives into a flow of water, which discharges through a shower head or faucet. In embodiments that are employed in conjunction with a shower head or faucet, additives may have cleansing, moisturizing, or scent-producing characteristics, among other things. One or more additives may be selected from a group of additives that includes, but is not limited to, liquid, granular, semi-solid or solid soaps, conditioners, fragrances, and body oils.

Figure 1:
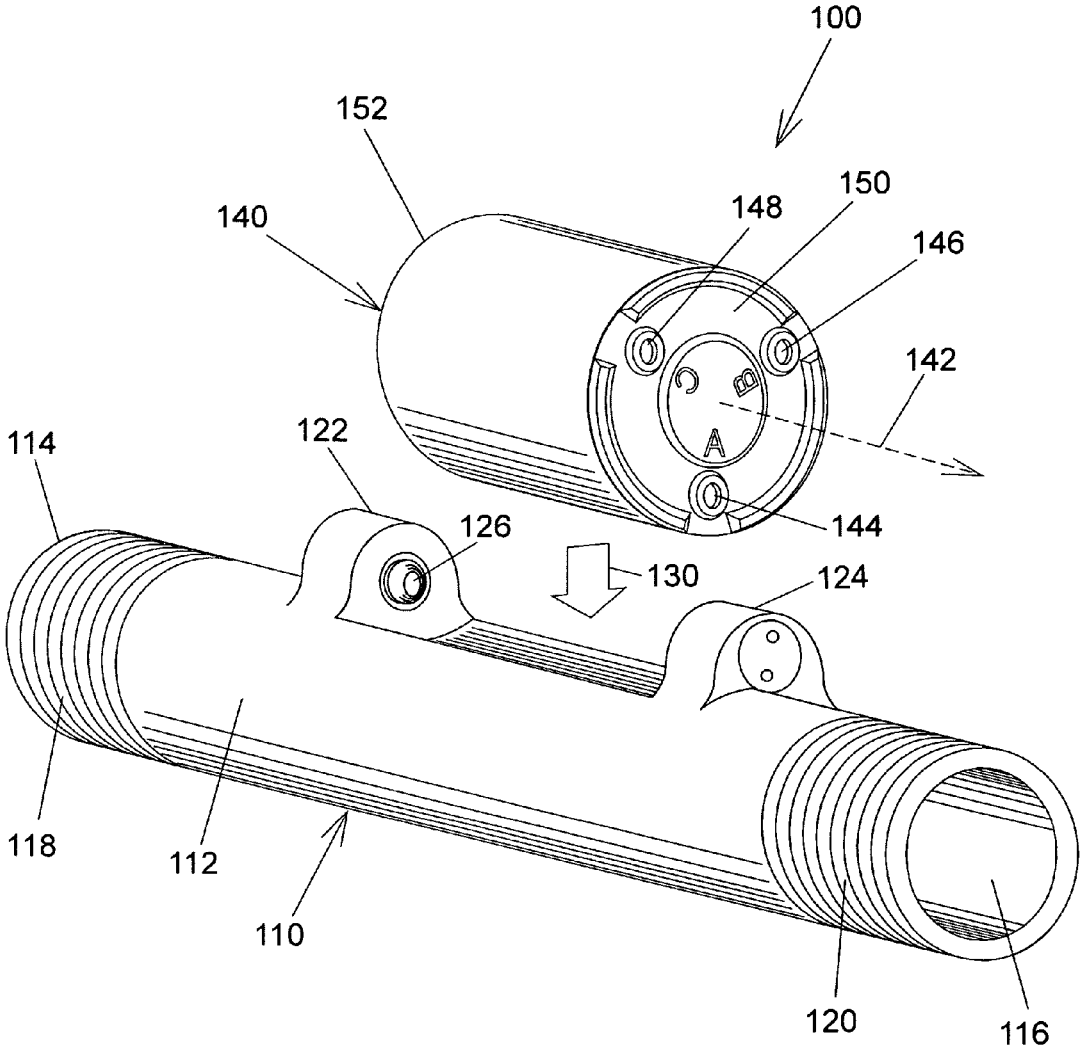
FIG. 1 illustrates a perspective view of a disengaged, additive introduction apparatus, in accordance with an example embodiment of the inventive subject matter.

FIG. 1 illustrates a perspective view of a disengaged, additive introduction apparatus 100, in accordance with an example embodiment of the inventive subject matter. In an embodiment, additive introduction apparatus 100 includes a primary flow fixture 110 and an additive vessel 140.

Primary flow fixture 110 includes a main body 112 with at least one primary fluid inlet 114 and at least one primary fluid outlet 116. Although only one primary fluid inlet 114 and one primary fluid outlet 116 are illustrated, more than one inlet and/or outlet may be included, in other embodiments. For use in a typical domestic shower, primary fluid inlet 114 may be connected to a water supply (e.g., a household plumbing system which has a termination point at a shower), and primary fluid outlet 116 may be connected to a shower head. For example, primary flow fixture 110 may have suitable inlet threads 118 and outlet threads 120. The inlet threads 118 and the outlet threads 120 may be connectable to the water supply and the shower head, respectively. In an embodiment, both inlet threads 118 and outlet threads 120 may be compatible with standard plumbing connections to facilitate installation.

For example, the primary flow fixture 110 may be installed by unscrewing any existing connection between the water supply and the shower head, and screwing the primary flow fixture's inlet threads 118 to the water supply, and screwing the shower head to the primary flow fixture's outlet threads 120. In an alternate embodiment, a shower head may form a portion of the additive introduction apparatus, and thus a separate shower head need not be installed. Although inlet threads 118 and outlet threads 120 are illustrated on an exterior surface of primary flow fixture 110, either or both sets of threads may alternatively be located on an interior surface of primary flow fixture 110, in other embodiments.

During operation, fluid from a fluid supply (e.g., a water supply) flows into primary fluid inlet 114. The term "fluid supply," in various embodiments, means a fluid that is provided from an external source to a fluid inlet 114. The fluid may include water and/or other fluids. After entering the primary fluid inlet 114, the fluid supply flows through a hollow interior channel of apparatus 100 and out through primary fluid outlet 116. The fluid flow between the primary fluid inlet 114 and the primary fluid outlet 116 may be referred to herein as the "primary fluid flow." According to various embodiments, one or more additives located within additive vessel 140 may be added to the primary fluid flow, and the resulting mixture may be discharged through primary fluid outlet 116. The term "fixture discharge", in various embodiments, means a fluid that flows out of fluid outlet 116. When no additives are added to the primary fluid flow, then the fixture discharge may have substantially the same composition as the fluid supply. When one or more additives are added to the primary fluid flow, then the fixture discharge may be an additive-containing discharge.

Primary flow fixture 110 includes a vessel mounting assembly, in an embodiment. The vessel mounting assembly includes at least one inlet mounting portion 122 and at least one outlet mounting portion 124. In an embodiment, vessel mounting assembly 122,124 is configured to accept an additive vessel (e.g., additive vessel 140). Additive vessel 140 may be engaged with vessel mounting assembly 122,124, in an embodiment, by pressing additive vessel 140 into vessel mounting assembly 122,124, in a direction indicated generally by arrow 130. In an embodiment, additive vessel 140 and vessel mounting assembly 122, 124 may be engaged using a moderate amount of force. The term "engaged with," as used herein, means that additive vessel 140 and vessel mounting assembly 122, 124 are physically connected to each other, such that rotation of additive vessel 140 about its central axis 142 may be achieved while maintaining the connection between additive vessel 140 and vessel mounting assembly 122, 124. Further, in an embodiment, additive vessel 140 maybe disengaged from vessel mounting assembly 122, 124 by pulling additive vessel 140 in a direction away (e.g., opposite arrow 130) from vessel mounting assembly 122, 124 using a moderate amount of force.

In the illustrated embodiment, additive vessel 140 includes three outlet ports 144, 146,148 on an outlet side 150, which are labeled "A," "B," and "C," respectively. Additive vessel 140 also includes an inlet port (hidden in FIG. 1) for each of the outlet ports 144, 146, 148 on an inlet side 152, in an embodiment. Further, in an embodiment, additive vessel 140 includes one or more interior chambers, each of which may include zero or more additives. In an embodiment, the interior chambers are sealed off from each other.

Each interior chamber has at least one inlet port (hidden in FIG. 1) on inlet side 152 and at least one outlet port (e.g., port 144) on outlet side 150. An inlet port and outlet port set associated with a particular chamber may be referred to herein as a "complementary port set." Accordingly, for example, when additive vessel 140 includes three interior chambers, additive vessel 140 may include three complementary port sets. In alternate embodiments, each interior chamber may have associated therewith more than one inlet port and/or outlet port. Further, although embodiments are illustrated and described for an additive vessel 140 having three interior chambers and three complementary port sets, more or fewer interior chambers and complementary port sets may be included in additive vessels according to other embodiments.

For example, in an alternate embodiment, a first additive vessel may include a single additive-containing chamber. A user may engage the first additive vessel with the vessel mounting assembly of the primary flow fixture, and the user may manipulate the first additive vessel, if necessary, to start the introduction of a first additive. As an example, a first additive may be a shampoo or another detergent optimized for hair cleansing. If and when the first additive is no longer desired, the user may disengage the first additive vessel from the vessel mounting assembly by removing the first additive vessel. Alternatively, the user may rotate the first additive vessel so that the input and output nozzles and ports close. In this state, the first additive no longer enters the primary fluid flow. Rinsing may be accomplished at this point. Alternatively, the user may replace the first additive vessel with a different additive vessel to access a different additive. The procedure may be repeated for as many additive cycles and rinsing cycles as the user desires. The primary fluid flow effectively may clear the presence of a previous additive before a next additive is introduced. In an embodiment, whether the user is engaging an additive vessel, disengaging an additive vessel, or rotating an additive vessel through one or more settings, the primary fluid flow may not substantially be interrupted.

In an embodiment, additive vessel 140 and vessel mounting assembly 122, 124 include complementary mechanical features, which, when engaged with each other, enable additive vessel 140 to be rotated around its central axis 142 while remaining engaged with vessel mounting assembly 122,124. The complementary mechanical features also facilitate alignment, when desired, of inlet and outlet nozzles of primary flow fixture 110 with inlet and outlet ports of additive vessel 140, as is described further in the next paragraph.

Inlet mounting portion 122 of the vessel mounting assembly includes an inlet nozzle 126, which may mate with an inlet port on inlet side 152 of additive vessel 140. In addition, outlet mounting portion 124 of the vessel mounting assembly includes an outlet nozzle (hidden in FIG. 1), which may mate with outlet ports (e.g., ports 144, 146, 148) of additive vessel 140. Alignment of the inlet and outlet nozzles of vessel mounting assembly 122,124 with a complementary set of inlet and outlet ports of additive vessel 140 may be achieved when a user manipulates additive vessel 140 with respect to vessel mounting assembly 122,124. For example, in an embodiment a user may rotate additive vessel 140 about its central axis 142, when additive vessel 140 is engaged with vessel mounting assembly 122, 124, until alignment between the nozzles and ports is achieved.

When alignment between the nozzles of vessel mounting assembly 122, 124 and a complementary set of ports of additive vessel 140 is achieved, the nozzles and complementary set of ports may open, by virtue of the pressure exerted between them. When the nozzles and a complementary set of ports are aligned and open, they may be referred to herein as being "activated." When they are not open (e.g., they are closed), they may be referred to herein as being "deactivated." When the arrangements of nozzles and ports are activated, diverted portions of the primary fluid flow may flow from the primary flow fixture to additive vessel and from additive vessel to primary flow fixture. Activation and deactivation of nozzles and ports are described in more detail later in conjunction with FIG. 2.

When the nozzles and a complementary set of ports are activated, a portion of the primary fluid flow may be diverted from the interior channel of primary flow fixture 110, through an inlet nozzle (e.g., nozzle 126) and an inlet port of additive vessel 140, and into a chamber of additive vessel 140. The diverted fluid may combine with an additive that may be located within the interior chamber, if any additive is actually located within the chamber. Combination may be achieved when the additive is mixed with or dissolved into the diverted fluid. Pressure exerted from additional diverted fluid entering the chamber may force the additive-containing fluid through an outlet port (e.g., port 144) and an outlet nozzle. The additive-containing fluid may then combine with the primary fluid flow, which thereafter exits the primary flow fixture 110 through primary fluid outlet 116.

In an embodiment, at any given time, the primary flow fixture 110 and the additive vessel 140 may be in one of three physical states with respect to each other, which states include: 1) a disengaged state; 2) an engaged and unaligned state; and 3) an engaged and aligned state. In an embodiment, transition between the physical states may be accomplished without interrupting the primary fluid flow.

In an embodiment, in the disengaged state, additive vessel 140 is not engaged with vessel mounting assembly 122, 124. In this state, the vessel mounting assembly nozzles (e.g., nozzle 126) may remain closed or deactivated. Accordingly, in the disengaged state, fluid from a fluid supply flows into primary fluid inlet 114, through the hollow interior channel of primary flow fixture 110, and out through primary fluid outlet 116 without the addition of additives. In this state, the fixture discharge may have substantially the same composition as the fluid supply.

In an embodiment, in the engaged and unaligned state, additive vessel 140 is engaged with vessel mounting assembly 122, 124 but the vessel mounting assembly nozzles (e.g., nozzle 126) are not aligned with a complementary set of the additive vessel ports. In this state, the vessel mounting assembly nozzles and the additive vessel ports remain closed or deactivated. Accordingly, fluid from a fluid supply flows into primary fluid inlet 114, through the hollow interior channel of primary flow fixture 110, and out through primary fluid outlet 116 without passing through additive vessel 140 and without the addition of additives. In this state, the fixture discharge may have substantially the same composition as the fluid supply.

In an embodiment, in the engaged and aligned state, additive vessel 140 is engaged with vessel mounting assembly 122, 124 and the vessel mounting assembly nozzles (e.g., nozzle 126) are aligned with a complementary set of the additive vessel ports. In this state, the vessel mounting assembly nozzles and the aligned, complementary set of additive vessel ports may be open or activated. Accordingly, a diverted portion of the fluid supply may flow into a chamber of the additive vessel 140, which is associated with the aligned, complementary set of ports. When flowing through the chamber, an additive located within the chamber may combine with the diverted portion of the fluid supply, thus producing an additive-containing fluid. Pressure provided from additional diverted portions of the fluid supply entering the chamber may force the additive-containing fluid out through an outlet port (e.g., port 144) and an outlet nozzle of the vessel mounting assembly. The additive-containing fluid may then re-combine with the primary fluid supply, and the resulting combination flows out through primary fluid outlet 116. In this state, the fixture discharge may be an additive containing fluid discharge.

When additive vessel 140 and vessel mounting assembly 122, 124 are transitioned to an engaged and aligned state from either a disengaged state or an engaged and unaligned state, the vessel mounting assembly nozzles automatically open, thus allowing fluid flow into, through, and out of additive vessel 140. When additive vessel 140 and vessel mounting assembly 122,124 are transitioned from an engaged and aligned state to either a disengaged state or an engaged and unaligned state, the vessel mounting assembly nozzles automatically close, thus preventing fluid flow into additive vessel 140.

Figure 2:
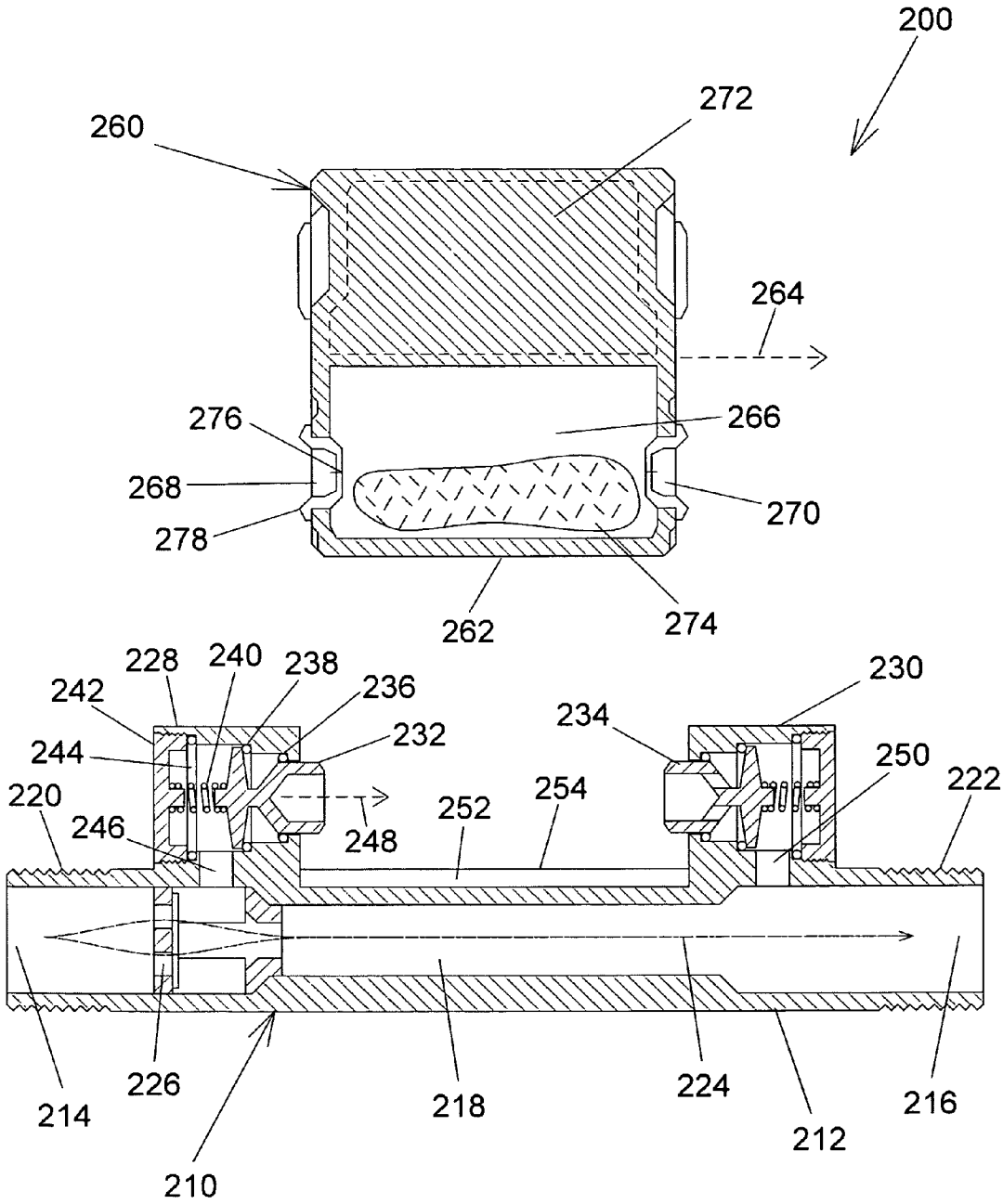
FIG. 2 illustrates a cross-sectional view a disengaged, additive introduction apparatus, in accordance with an example embodiment.

FIG. 2 illustrates a cross-sectional view a disengaged, additive introduction apparatus 200, in accordance with an example embodiment. In an embodiment, additive introduction apparatus 200 includes a primary flow fixture 210 and an additive vessel 260.

Primary flow fixture 210 includes a main body 212 with at least one primary fluid inlet 214, at least one primary fluid outlet 216, and a hollow interior channel 218 between the primary inlet 214 and primary outlet 216. Primary flow fixture 210 may have suitable inlet threads 220 and outlet threads 222, as described previously. Although inlet threads 220 and outlet threads 222 are illustrated on an exterior surface of primary flow fixture 210, either or both sets of threads may alternatively be located on an interior surface of primary flow fixture 210, in other embodiments.

In an embodiment, primary flow fixture 210 has a length in a range of approximately 10 cm to 30 cm, and a fluid inlet/outlet diameter in a range from 1.5 cm to 5 cm, although the length and/or diameter may be larger or smaller than the above ranges, in other embodiments.

During operation, fluid from a fluid supply (e.g., a water supply) flows into primary fluid inlet 214, through hollow interior channel 218, and out through primary fluid outlet 216. Primary flow fixture 210 has a direct fluid path 224 from primary fluid inlet 214 to primary fluid outlet 216. In an embodiment, primary flow fixture 210 may include a backflow prevention device 226 to prevent additive-containing fluid from siphoning back to the fluid supply when the fluid flow is stopped.

In an embodiment, primary flow fixture 210 includes a vessel mounting assembly. The vessel mounting assembly includes at least one inlet mounting portion 228 and at least one outlet mounting portion 230. In an embodiment, primary flow fixture 210 also may include one or more restrictions (not illustrated) in the direct fluid path 224 between the inlet mounting portion 228 (or the inlet nozzle assembly) and the outlet mounting portion 230 (or the outlet nozzle assembly), which may function to provide an increased pressure differential between the inlet mounting portion 228 and the outlet mounting portion 230. This may have a result of adjusting the ratio of fluid flowing into the additive vessel 260 in proportion to the primary fluid flow to achieve desired mixing rates for an additive. The restrictions may be fixed or adjustable by a user, in various embodiments.

Inlet mounting portion 228 has an inlet nozzle assembly associated with it, and outlet mounting portion 230 has an outlet nozzle assembly associated with it. An inlet nozzle valve 232 is accessible from an exterior of inlet mounting portion 228, and an outlet nozzle valve 234 is accessible from an exterior of outlet mounting portion 230. Components of an inlet nozzle assembly and an outlet nozzle assembly may be substantially similar, so only one assembly will be described in the next paragraph. In other embodiments, the inlet and outlet nozzle assemblies may include different components.

In an embodiment, a nozzle assembly is included within an inlet or outlet mounting portion (e.g., inlet mounting portion 228 or outlet mounting portion 230). A nozzle assembly includes a nozzle valve 232, valve seat seal 238, nozzle seal 236, return spring 240, an access plug 242, plug seal 244, and one or more openings 246, in an embodiment. Nozzle valve 232 may be movable along its central axis 248 to permit fluid diverted from the primary fluid flow to flow through the nozzle assembly or to close against fluid flow. Valve seat seal 238 may function to assist in maintaining a fluid-tight seal when nozzle valve 232 is in the closed position. Nozzle seal 236 may function to provide a fluid-tight seal while allowing nozzle valve 232 to retract and permit fluid flow. Return spring 240 may include a compression spring, which may function to assist in returning nozzle valve 232 to a closed position when nozzle valve 232 is not aligned with a port (e.g., port 268) of an additive vessel (e.g., additive vessel 260). Access plug 242 may function to permit initial assembly or replacement of the nozzle assembly components. Plug seal 244 may function to provide a fluid-tight seal at the plug opening. Opening 246 may function to allow fluid to be diverted from the direct fluid path 224. An opening 250 in the outlet nozzle assembly may allow fluid to be returned to the direct fluid path 224.

In an embodiment, selected ones of seals 236,238,244 may include O-rings. In various embodiments, to help maintain a fluid-tight seal, seals 236,238,244 may be formed from a compliant material such as natural rubber, neoprene, or other suitable elastomers, for example but not by way of limitation. In alternate embodiments, seals 236,238,244 may be implemented in alternate forms, combined, and/or some or all of seals 236,238,244 may be eliminated.

In an embodiment, primary flow fixture 210 also may include a vessel support 252, which may provide for added stability for an additive vessel (e.g., vessel 260) when the additive vessel is engaged with the primary flow fixture 210. In an embodiment, vessel support 252 may have an outer surface 254 with a radius that approximates the radius of the outer surface 262 of the additive vessel 260, so that the installed additive vessel 260 may be stably held against the vessel support 252, while remaining rotatable about its central axis 264.

In an embodiment, additive vessel 260 includes one or more interior chambers, such as interior chamber 266, and one or more complementary port sets, such as complementary port set 268,270. In an embodiment, the interior chambers are separated from each other by interior partitions (e.g., partition 272). Each interior chamber may include zero or more additives, such as additive 274.

In an embodiment, additive vessel 260 has a length (e.g., along central axis 264) in a range of approximately 3 cm to 15 cm and a diameter in a range from 3 cm to 10 cm, although the length and/or diameter may be larger or smaller than the above ranges, in other embodiments.

A complementary port set includes an inlet port (e.g., port 268) and an outlet port (e.g., port 270), which may provide openings into a particular interior chamber (e.g., interior chamber 266). In an embodiment, additive vessel 260 includes three interior chambers and three complementary port sets. More or fewer interior chambers and complementary port sets may be included in additive vessels according to other embodiments. Further, each interior chamber may have associated therewith more than one inlet port and/or outlet port, in other embodiments.

In an embodiment, an inlet port 268 and an outlet port 270 of a complementary port set are positioned in additive vessel 260 to align with and mate with an inlet nozzle valve 232 and an outlet nozzle valve 234, respectively, when additive vessel 260 is engaged with primary flow fixture 210, and the inlet and outlet ports 268, 270 are aligned with the inlet and outlet nozzle valves 232, 234. Components of an inlet port and an outlet port may be substantially similar, so only one port will be described in the next paragraph. In other embodiments, the inlet and outlet ports may include different components.

In an embodiment, a port (e.g., port 268) includes an opening 276 and a nozzle seat 278. Opening 276 may allow or restrict fluid flow into or out of additive vessel 260. Nozzle seat 278 may function to hold additive vessel 260 in place with respect to primary flow fixture 210. In addition or alternately, nozzle seat 278 may function to press against a nozzle valve (e.g., inlet nozzle valve 232) while sealing against the nozzle valve to prevent the escape of fluid from inside the apparatus 200. On the inlet side, this results in a fluid flow from the inlet nozzle assembly into an interior chamber (e.g., chamber 266) of the additive vessel 260. On the outlet side, this results in a fluid flow from the interior chamber (e.g., chamber 266) of the additive vessel 260 into the outlet nozzle assembly. In an embodiment, to provide a fluid-tight seal against a nozzle valve (e.g., nozzle valve 232), nozzle seat 278 may be formed from a suitably compliant material such as natural rubber, neoprene, or other elastomers, for example but not by way of limitation. A nozzle seat 278 also may include a self-sealing feature, such as a slit. A self-sealing feature may open adequately to permit fluid flow when pressure is applied by the fluid and the nozzle assembly during operation, or a self-sealing feature may close to prevent fluid flow when the nozzle assembly and the port are disengaged, and the pressure inside the additive vessel has equalized to ambient. In various embodiments, nozzle seat 278 may be formed from a same material or a different material from additive vessel 260.

In an embodiment, additive vessel 260 has dimensions such that the inlet and outlet nozzle valves 232,236 of primary flow fixture 210 are open when additive vessel 260 is engaged with the primary flow fixture 210, and the inlet and outlet ports 268, 270 of additive vessel 260 press against the nozzle valves 232, 236 in an axial direction (e.g., the nozzles and ports are aligned). In this engaged and aligned state, the nozzle valves 232,236 and the ports 268,270 may allow fluid to enter and exit the interior chamber 266 of the additive vessel 260. When a nozzle seat (e.g., nozzle seat 278) is not aligned with a nozzle valve (e.g., nozzle valve 232), the nozzle valve may remain in or return to a closed position, and the nozzle valve no longer permits fluid flow into the interior chamber 266.

In an embodiment, a track or tracks may be incorporated into the design of an additive vessel (e.g., additive vessel 260) to provide clearance for the nozzle valves (e.g., nozzle valves 232, 236) and to allow the nozzle valves to close when the nozzle seats (e.g., nozzle seat 278) are disengaged from the nozzle valves. By incorporating such a feature, an additive vessel may be disengaged without completely removing it from a primary flow fixture (e.g., primary flow fixture 210). Such a feature may help to maintain the alignment of an additive vessel and a primary flow fixture while a user is manipulating the apparatus 200 into another operating position.

Within additive vessel 260, each interior chamber (e.g., chamber 266) may contain a different additive (e.g., additive 274) or no additive. An additive may be in fluid, granular, solid, or semi-solid form (e.g., gel form). An additive material desirably is capable of dispensing into a fluid, either by entering the fluid in solution, dissolving in the fluid or entering the fluid as a fine paniculate. By allowing a fluid flow through additive vessel chamber 266, such that the fluid passes through or over or is otherwise in contact with the additive 274, some portion of the additive may be drawn along by the fluid and the mixing process may be initiated. The fluid plus additive may then exit the additive vessel 260 and join the primary fluid flow in the primary flow fixture 210. Once in the primary flow fixture 210, the mixing process may continue, and the additive may be diluted to a final proportion. The fluid flow plus additive exits the primary flow fixture 210 through outlet 216, as previously described.

In an embodiment, a primary flow fixture 210 and an additive vessel 260 are compatible as to the configuration of nozzles 232,234, ports 268, 270, and dimensions to permit efficient engagement for use in the intended manner. In other words, the primary flow fixture 210 automatically recognizes a compatible additive vessel 260 by design. This feature may prevent the use of additive vessels of incompatible design, and thereby may prevent the use of certain additives with certain fixture installations, as might be desirable, for example, if the additive vessel contained a medication not intended for general use. Automatic additive vessel recognition may be further enhanced with the addition of complementary protrusions, keys, grooves, dimples, and/or other features on the primary flow fixture 210 and/or the additive vessel 260. In this manner, additive vessels with certain arrangements may be excluded from use with certain primary flow fixtures. Complementary protrusions, keys, grooves, dimples, and/or other features on the primary flow fixture 210 and/or the additive vessel 260 also may function as tracks, guides or positioning detents to aid in aligning an additive vessel with a primary flow fixture.

Physical compatibility of an additive vessel and a primary flow fixture, even when enhanced as described above, may allow considerable latitude in the design of the additive vessel. For example, portions of the additive vessel that do not engage with the primary flow fixture may be of arbitrary shape, limited only by practical considerations of manufacture or usage. Further, the interior of an additive vessel may be configured as needed to best suit the additive materials contained within. The interior of an additive vessel may be designed, for example, to effect efficient deployment of an additive to a fluid flow. Certain aspects of an additive vessel also may be varied intentionally to control or optimize mixing rates. For example, adjusting the dimensions of an additive vessel or a nozzle seat (e.g., nozzle seat 278) so that a nozzle valve (e.g., nozzle valve 232) is more fully opened when the nozzle seat is in alignment may increase the rate of fluid flow through the additive vessel. As another example, reducing the size of the opening (e.g., opening 276) into an additive vessel may effectively reduce the fluid flow into the additive vessel. Adjustments such as these, either to a primary flow fixture 210 or to an additive vessel 260 may be used to obtain desired dilution rates for a wide range of additives and applications.

Figure 3:
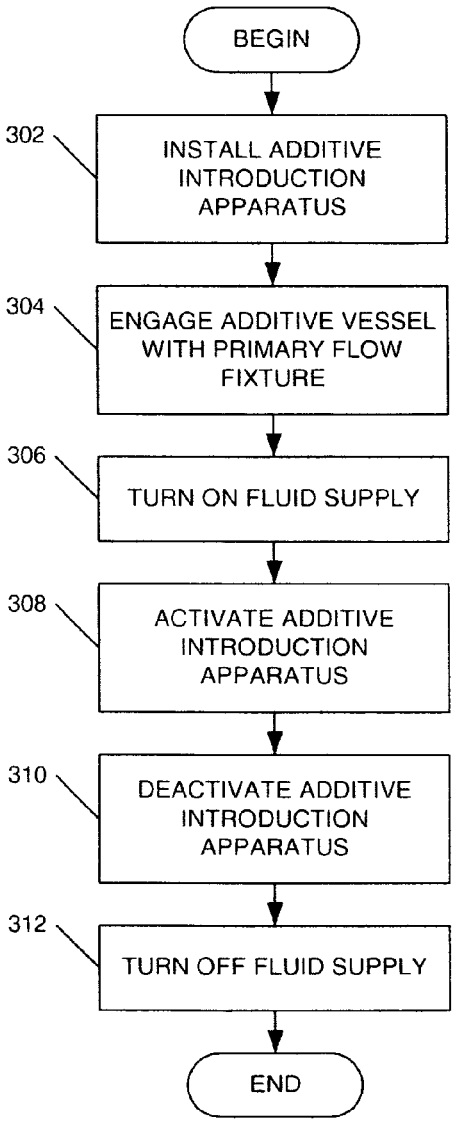
FIG. 3 illustrates a flowchart of a method for using an additive introduction apparatus, in accordance with an example embodiment.

FIG. 3 illustrates a flowchart of a method for using an additive introduction apparatus, in accordance with an example embodiment. The method may begin, in block 302, by installing an additive introduction apparatus (e.g., apparatus 100, FIG. 1) to an existing fluid source. In an embodiment, a primary flow fixture (e.g., fixture 110, FIG. 1) and an additive vessel (e.g., additive vessel 140, FIG. 1) may be installed together as a unit. In an alternate embodiment, a primary flow fixture may be installed without an additive vessel engaged with it. For example, when an embodiment is used in conjunction with a shower application, the primary flow fixture's inlet threads (e.g., threads 118, FIG. 1) may be screwed to the piping for the water supply, and a shower head may be screwed to the primary flow fixture's outlet threads (e.g., threads 120, FIG. 1). In an alternate embodiment, a shower head may form a portion of the additive introduction apparatus, and thus a separate shower head may not be installed. In still other embodiments, an additive introduction apparatus could be installed on a faucet, hose bib, hose, sprayer, or other apparatus associated with a water source or other type of fluid source.

When a primary flow fixture (e.g., fixture 110, FIG. 1) has been installed without an additive vessel (e.g., additive vessel 140, FIG. 1) engaged with it, then in block 304, an additive vessel may be engaged with the primary flow fixture. In an embodiment, an additive vessel may be engaged with a vessel mounting assembly (e.g., assembly 122,124, FIG. 1) of a primary flow fixture by pressing the additive vessel into the vessel mounting assembly, as described previously. In an embodiment, an additive vessel and vessel mounting assembly may be engaged using a moderate amount of force. When a primary flow fixture and an additive vessel are in an engaged state, they may be aligned or unaligned.

The fluid supply (e.g., water supply) may be turned on, in block 306, thus causing the fluid supply to flow through the primary flow fixture. In an alternate embodiment, the fluid supply may be turned on prior to engaging an additive vessel (e.g., prior to block 304). For example, in a shower application, a user may turn on the shower water. When the additive vessel and the primary flow fixture are in an engaged and unaligned state, the fixture discharge may be substantially the same as the fluid supply. For example, in a shower application, the fixture discharge may be clean water from the water supply, without additives from the additive vessel.

Assuming that the additive vessel (e.g., vessel 260) and the primary flow fixture (e.g., primary flow fixture 210) are in an engaged an unaligned state, then in block 308, the user may then activate the apparatus to add a first additive to the fluid flow. For example, the user may manipulate the additive vessel (e.g., rotate the additive vessel about its central axis 264, FIG. 2) so that a first set of complementary ports (e.g., ports 268,270, FIG. 2) of the additive vessel are aligned with inlet and outlet nozzles (e.g., nozzles 232,234, FIG. 2) of the primary flow fixture. For example, the first set of complementary ports may be associated with a chamber (e.g., chamber 266, FIG. 2) that includes shampoo as an additive (e.g., additive 274, FIG. 2). A diverted portion of the primary fluid flow may mix with the shampoo in the chamber, and the resulting shampoo-containing fluid may exit the chamber and mix with the primary fluid flow. The fixture discharge then may include water and the shampoo, and the user may wash his or her hair.

When a user would like to deactivate the apparatus (e.g., to provide no additive), then in block 310, the user may manipulate the additive vessel so that either: 1) the additive vessel and the primary flow fixture are in an engaged and unaligned state; or 2) the additive vessel and the primary flow fixture are in an engaged an aligned state, where alignment is with a chamber that is empty (e.g., contains no additive); or 3) the additive vessel and the primary flow fixture are disengaged from each other. As described previously, an additive vessel may be disengaged from the vessel mounting assembly by pulling the additive vessel in a direction away from the vessel mounting assembly using a moderate amount of force. After disengagement of an additive vessel, a user may engage another additive vessel, if desired.

The user may repeat blocks 308 and/or 310 as many times as desired to add different additives (e.g., by aligning other complementary port sets) to the primary fluid flow, or to provide no additive. For example, in the shower application, when a user has shampooed his or her hair for a desired amount of time, the user may manipulate the additive vessel to provide no additive for rinsing purposes. The user may thereafter manipulate the additive vessel to add a soap additive in another chamber, then to rinse again, then to add a body oil additive in yet another chamber, and then to rinse again. This process may be repeated as few or as many times as desired by the user. Eventually, the fluid supply may be turned off, in block 312, and the method may end.

Figure 4:
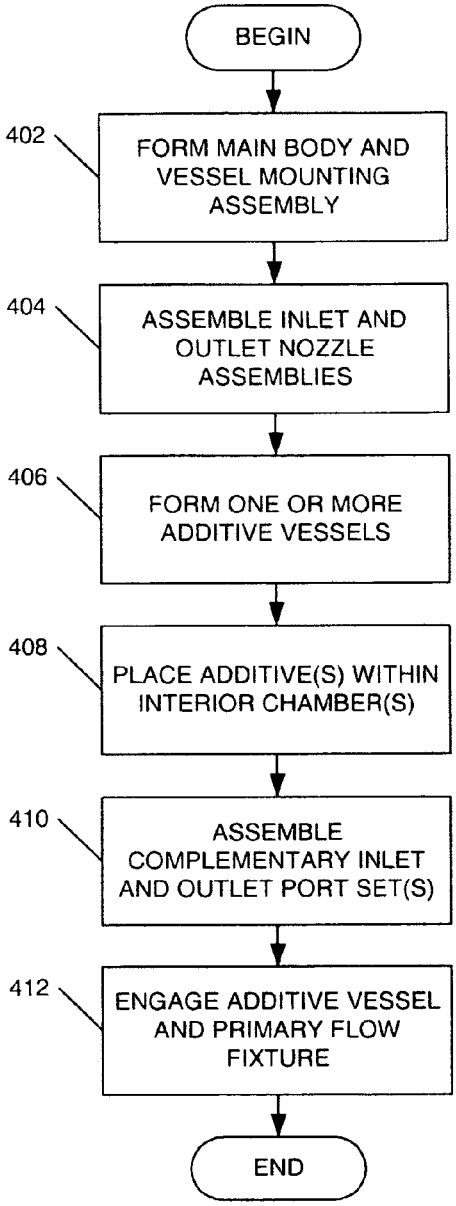
FIG. 4 illustrates a flowchart of a method for making an additive introduction apparatus, in accordance with an example embodiment.

FIG. 4 illustrates a flowchart of a method for making an additive introduction apparatus, in accordance with an example embodiment. In an embodiment, the method includes forming a main body (e.g., main body 112, FIG. 1) and a vessel mounting assembly (e.g., inlet and outlet mounting portions 122, 124, FIG. 1) of a primary flow fixture (e.g., fixture 110, FIG. 1), in block 402. In an embodiment, the main body and/or vessel mounting assembly may be formed from stainless steel, brass, or other metals, plastics or ceramics, which are chemically and mechanically suitable for the application. The main body and/or vessel mounting assembly may be formed using techniques such as casting, molding, machining, sintering or other forming techniques suited to the materials used. In an embodiment, the main body and vessel mounting assembly are formed from a single piece of material. In other embodiments, the main body and vessel mounting assembly may be formed from multiple components, which are connected together.

In block 404, an inlet nozzle assembly and an outlet nozzle assembly are assembled with the inlet mounting portion (e.g., inlet mounting portion 122, FIG. 1) and outlet mounting portion (e.g., outlet mounting portion 124, FIG. 1), respectively. In an embodiment, this may include inserting any seals (e.g., seals 236, 238, 244, FIG. 2) into the inlet or outlet mounting portion, inserting a nozzle (e.g., nozzle 232, FIG. 2), placing a spring (e.g., spring 240, FIG. 2) onto the nozzle end, and screwing or pressing an access plug (e.g., plug 242, FIG. 2) into place.

In block 406, one or more additive vessels (e.g., additive vessel 140, FIG. 1) are formed. In an embodiment, an additive vessel may be formed from stainless steel, brass, or other metals, plastics or ceramics, which are chemically and mechanically suitable for the application. The additive vessel may be formed using techniques such as casting, molding, machining, sintering or other forming techniques suited to the materials used. In an embodiment, an additive vessel is formed from a single piece of material. In other embodiments, an additive vessel may be formed from multiple components, which are connected together.

In block 408, one or more additives (e.g., additive 274, FIG. 2) may be placed within the interior chambers (e.g., interior chamber 266, FIG. 2) of an additive vessel. For example, fluid, granular, semi-solid or solid additives such as shampoo, cleanser, fragrance, body oil, or other additives may be placed in the interior chambers. In an alternate embodiment, additives may later be placed in the interior chambers by a user, rather than during manufacturing.

In block 410, complementary inlet and outlet port sets (e.g., ports 268, 270, FIG. 2) are assembled with an additive vessel. In an embodiment, this may include pressing a nozzle seat (e.g., nozzle seat 278, FIG. 2) into a port opening (e.g., opening 276, FIG. 2). Nozzle seats may be formed of a compliant material, such as natural rubber, neoprene or other elastomers, for example but not by way of limitation. In some embodiments, a nozzle seat may be formed of a same material as an additive vessel (e.g., additive vessel 140, FIG. 1). A nozzle seat may be formed as a separate component or as an integral part of an additive vessel, in various embodiments.

In block 412, an additive vessel (e.g., additive vessel 140, FIG. 1) maybe engaged with a primary flow fixture (e.g., primary flow fixture 110, FIG. 1), and the assembly may be packaged in this configuration. In an alternate embodiment, one or more additive vessels may be packaged with a primary flow fixture in a disengaged state. The method then ends.

The flowcharts illustrated in FIGS. 3 and 4 show processes occurring in a specific sequence. In other embodiments, the processes may occur in other sequences, some of the processes may occur in parallel, some of the processes may be combined, and/or some of the processes may be eliminated. Accordingly, the specific embodiment illustrated is not meant to limit the scope of the inventive subject matter only to the illustrated sequences.

Embodiments of the inventive subject matter may provide one or more of the following: 1) an ability for a user readily to configure the apparatus to introduce one or more additives into a fluid flow, as well as to configure the apparatus so that no additives are introduced into the fluid flow; 2) an ability for a user to change additives or configure the apparatus to a no-additive setting using a simple manual operation; 3) substantial elimination of residue (e.g., flushing out) of a first additive in a dispensing channel (e.g., channel 232, FIG. 2), after switching from a first setting, which dispenses the first additive, to a second setting, which dispenses a second additive or no additive; 4) providing a consistent additive introduction rate even for different or variable fluid flow rates; and/or 5) an ability to switch between additive settings (or a no-additive setting) without substantially interrupting a primary fluid flow.

Various embodiments of a method and apparatus for introducing one or more additives into a fluid flow have been described. In the description of the embodiments, above, reference is made to the accompanying drawings, which form a part hereof and show, byway of illustration, specific embodiments in which the inventive subject matter may be practiced. These embodiments are described in sufficient detail to enable those skilled in the art to practice the inventive subject matter, and it is to be understood that other embodiments may be utilized, and that process or mechanical changes may be made, without departing from the scope of the inventive subject matter.

It will be appreciated by those of ordinary skill in the art that any arrangement that is calculated to achieve the same purpose may be substituted for the specific embodiments shown. Many adaptations of the inventive subject matter described herein will be apparent to those of ordinary skill in the art. Accordingly, this application is intended to cover any adaptations or variations of the inventive subject matter. In particular, but not by way of limitation, the type of application within which the embodiments are incorporated can be different from that illustrated and described above.

For example, although a shower application of embodiments are discussed in some detail, herein, it would be apparent to one of skill in the art, based on the description herein, how embodiments of the inventive subject matter could be adapted for other domestic or non-domestic applications. For example, but not by way of limitation, embodiments may be used in conjunction with hoses, hose bibs, spray guns or nozzles, industrial fluid supplies, plumbing system components, and/or in conjunction with other applications. The examples listed above are not meant to limit the scope of the present invention. Instead, it would be apparent to one of skill in the art how to modify embodiments of the inventive subject matter to apply to other applications.

Although introduction of additives into water is described in detail herein, embodiments may be used to introduce additives into other fluids, as well. Further, although introduction of certain types of additives are discussed herein, embodiments may be used to introduce other types of additives, including additives selected from a group of additives that includes, but is not limited to, medications, pesticides, fertilizers, fire retardants, lubricants, anti-oxidants, and anti-foaming agents.

It is manifestly intended that the inventive subject matter be limited only by the following claims and equivalents thereof.

What is claimed is:

1. A method for using an additive introduction apparatus, the method comprising: causing a fluid supply to flow through the additive introduction apparatus; and activating the additive introduction apparatus to add an additive into the fluid supply, wherein activating the additive introduction apparatus includes manipulating an additive vessel of the additive introduction apparatus with respect to a primary flow fixture of the additive introduction apparatus by rotating the additive vessel about a central axis so that nozzle assemblies of the primary flow fixture are aligned with ports of the additive vessel, thus activating the nozzle assemblies by pressure exerted by the ports to divert a portion of the fluid supply into the additive vessel, wherein the portion of the fluid supply may mix with the additive within the additive vessel, and the portion of the fluid supply containing the additive may exit the additive vessel and re-combine with the fluid supply flowing through the primary flow fixture.

2. A method for making an additive introduction apparatus, the method comprising: forming a main body, which includes a primary fluid inlet, a primary fluid outlet, and an interior chamber between the primary fluid inlet and the primary fluid outlet; forming a vessel mounting assembly, which includes an inlet nozzle assembly with a nozzle valve that is biased in a closed position and may be pushed into an open position, to divert a portion of a primary fluid flow from the interior channel into an additive vessel, and an outlet nozzle assembly, to combine an additive-containing fluid from the additive vessel with the primary fluid flow; and forming the additive vessel, which is engagable with the vessel mounting assembly such that rotation of the additive vessel about a central axis may be achieved while maintaining contact between the additive vessel and the vessel mounting assembly, wherein the additive vessel includes at least one interior chamber and at least one complementary port set, wherein an inlet port of the complementary port set is aligned with the inlet nozzle assembly and pushes the inlet nozzle valve into an open position when an outlet port of the complementary port set is aligned with the outlet nozzle.

3. An additive vessel comprising: at least one interior chamber for combining therein an additive with a flow; and at least one complementary port set, wherein a complementary port set provides openings into an interior chamber of the at least one interior chamber, and wherein the complementary port set includes an inlet port and an outlet port, wherein the inlet port and the outlet port are positioned in the additive vessel to align with, mate with and push into an open position from a biased closed position an inlet nozzle valve and an outlet nozzle valve, respectively, of a primary flow fixture when the additive vessel is engaged with the primary flow fixture, wherein the additive vessel has a central axis, the additive vessel may be rotated around its central axis while maintaining a connection with the vessel mounting assembly, and the inlet port may be rotated into or out of alignment with the inlet nozzle.

4. The additive vessel of claim 3, wherein the at least one interior chamber comprises multiple chambers, and wherein the additive vessel further comprises at least one interior partition to separate the multiple chambers.

5. The additive vessel of claim 3, wherein the at least one interior chamber includes three chambers.

6. The additive vessel of claim 3, further comprising at least one additive, within the at least one interior chamber, wherein the at least one additive includes an additive selected from a group of additives that includes liquid, granular, semi-solid or solid soaps, conditioners, fragrances, body oils, medications, pesticides, fertilizers, fire retardants, lubricants, anti-oxidants, and anti-foaming agents.

7. An apparatus comprising:

a primary flow fixture main body which includes a primary fluid inlet, a primary fluid outlet, and an interior channel between the primary fluid inlet and the primary fluid outlet;

an additive vessel;

a vessel mounting assembly, attached to the primary flow fixture main body, wherein the vessel mounting assembly includes an inlet nozzle assembly with a central axis, to divert a portion of a primary fluid flow from the interior channel, parallel to the central axis, into the additive vessel to combine with an additive therein, and an outlet nozzle assembly, to combine an additive-containing fluid from the additive vessel with the primary fluid flow;

wherein the additive vessel is engagable with the vessel mounting assembly and includes at least one interior chamber and at least one complementary port set, wherein an inlet port of the complementary port set is aligned with the inlet nozzle assembly when an outlet port of the complementary port set is aligned with the outlet nozzle assembly; and wherein the inlet nozzle assembly includes a nozzle valve that is biased in a closed position, is pushed into an open position by the inlet port when the inlet port is aligned with the inlet nozzle valve, and returns to the closed position when the inlet port no longer is aligned with and pushing on the inlet nozzle valve, and wherein the inlet port may be aligned with the inlet nozzle valve by moving the inlet port in a plane perpendicular to the axis of the inlet nozzle assembly while maintaining contact with the inlet nozzle assembly.

8. The apparatus of claim 7, wherein the primary flow fixture further comprises a back-flow prevention device, within the primary flow fixture main body to prevent the additive-containing fluid from siphoning back to a fluid supply.

9. The apparatus of claim 7, wherein the primary flow fixture further comprises: one or more restrictions, within the primary flow fixture main body between the inlet nozzle assembly and the outlet nozzle assembly to provide a pressure differential between the inlet nozzle assembly and the outlet nozzle assembly.

10. The apparatus of claim 7, further comprising at least one additive, within the at least one interior chamber, wherein the at least one additive includes an additive selected from a group of additives that includes liquid, granular, semi-solid or solid soaps, conditioners, fragrances, body oils, medications, pesticides, fertilizers, fire retardants, lubricants, anti-oxidants, and anti-foaming agents.

11. The apparatus of claim 7 wherein the additive vessel may be disengaged by pulling it away from the vessel mounting assembly using a moderate amount of force.

12. The apparatus of claim 7 wherein the additive vessel has a central axis, the additive vessel may be rotated around its central axis while maintaining a connection with the vessel mounting assembly, and the inlet port may be rotated into or out of alignment with the inlet nozzle.

13. The apparatus of claim 7, wherein the inlet port and the outlet port are positioned in the additive vessel to align with, mate with and push into open position the inlet nozzle valve of the inlet nozzle assembly and the outlet nozzle valve of the outlet nozzle assembly, respectively, when the additive vessel is engaged with the vessel mounting assembly.

14. The apparatus of claim 13, wherein the outlet nozzle assembly includes a nozzle valve that is biased in a closed position, is pushed into an open position by the outlet port when the outlet port is aligned with the outlet nozzle valve, and returns to the closed position when the outlet port no longer is aligned with and pushing on the outlet nozzle valve and wherein the outlet port may be aligned with the outlet nozzle valve by moving the outlet port in a plane perpendicular to the axis of the outlet nozzle assembly while maintaining contact with the outlet nozzle.

* * * * *